US006749519B1

(12) United States Patent
Hasseler et al.

(10) Patent No.: US 6,749,519 B1
(45) Date of Patent: Jun. 15, 2004

(54) AUTOMATICALLY ACTUATED HIDDEN COMPARTMENT APPARATUS

(75) Inventors: Lawrence David Hasseler, Duarte, CA (US); James R. McCafferty, San Clemente, CA (US)

(73) Assignee: Jim McCafferty Productions, Inc., Santa Ana, CA (US)

( * ) Notice: Subject to any disclaimer, the term of this patent is extended or adjusted under 35 U.S.C. 154(b) by 0 days.

(21) Appl. No.: 10/388,573

(22) Filed: Mar. 14, 2003

Related U.S. Application Data

(60) Provisional application No. 60/364,236, filed on Mar. 15, 2002.

(51) Int. Cl.[7] ..... A63J 21/00
(52) U.S. Cl. ..... 472/71
(58) Field of Search ..... 472/57, 71, 137

(56) References Cited

U.S. PATENT DOCUMENTS 1,035,435 A * 8/1912 Hanlon ..... 472/71
1,266,647 A * 5/1918 Wickberg ..... 206/1.5
1,628,189 A * 5/1927 Raisner ..... 472/71
4,068,841 A * 1/1978 Kuna et al. ..... 472/69
4,557,476 A * 12/1985 Kato ..... 472/71
5,549,515 A * 8/1996 Kondo ..... 472/71

FOREIGN PATENT DOCUMENTS

DE 3634326 A1 * 4/1988 ..... A63J/21/00
GB 2218968 A * 11/1989 ..... A63J/21/00

* cited by examiner

*Primary Examiner*—Kien Nguyen
(74) *Attorney, Agent, or Firm*—Allan Grant; The Walker Law Firm

(57) ABSTRACT

The present invention is for an automatically actuated hidden compartment apparatus and method for creating the illusion that an object placed inside a chamber has disappeared. An automatically actuated hidden compartment apparatus comprises a housing, an outer compartment slidably coupled to the housing, an inner chamber slidably coupled to the inside of the outer compartment, and actuating means within the housing. When the inner chamber and outer compartment are slidably opened, an object is placed in the inner chamber. When the inner chamber and the outer compartment is closed, the actuating means is triggered, thereby preventing the inner chamber from sliding out of the housing. Then, when the outer compartment is opened an illusion is created that the object has disappeared. When the outer compartment is closed, the actuating means is triggered, thereby allowing the inner chamber to slide open. Then when the inner chamber and outer compartment is opened, the object reappears completing the illusion.

19 Claims, 4 Drawing Sheets

AUTOMATICALLY ACTUATED HIDDEN COMPARTMENT APPARATUS

CROSS-REFERENCE TO RELATED APPLICATIONS

The present application claims priority under 35 U.S.C. 119(e) and under all applicable U.S. statutes and regulations, to U.S. Provisional Application Ser. No. 60/364,236, filed Mar. 15, 2002 The disclosure of which is hereby incorporated herein by reference in its entirety.

FIELD OF THE INVENTION

The present invention generally relates to an illusion apparatus, and more particularly, to an apparatus for creating the illusion that an object placed inside a chamber has disappeared.

BACKGROUND OF THE INVENTION

Magic tricks have been around since the beginning of time and magicians, both professional and novice, have used various apparatus to trick and dazzle audiences. One apparatus in particular, commonly known as the magic drawer box, has been a favorite among magicians and audiences alike. The magic drawer box is an apparatus where the magician places an object in an open drawer, then closes the drawer and says a few magic words and upon subsequently opening the drawer, the object is gone and the drawer is empty. Thus, giving the illusion that the magician has magically made the object disappear. Continuing on, the magician closes the drawer box, saying some more magic words, and upon opening the drawer the original object reappears within the drawer. Magicians have performed such tricks with the aid of many devices such as drawer boxes, chest of drawers, and variations such as top hats.

The various apparatus of the prior art have required the magician to use sleight-of-hand techniques in manipulating the apparatus to activate a secret compartment by pressing a hidden button or switch to actuate a lever that engages an outer drawer and allows the magician to pull out an inner drawer that is either empty or has a different object from that originally placed in the drawer. Giving the illusion of either disappearance or transformation of the original object. The magician can then close the drawer and disengage the lever by once again pressing the button or switch to disengage the outer drawer and pull the drawer out once again to have the original object reappear.

Typically prior art devices require the user to activate a mechanism to lock one of the drawers to prevent both drawers from coming out when only one drawer is desired to be extracted. This requires practice and skill in sleight-of-hand techniques to activate the locking mechanism without anyone noticing.

Accordingly, there is a substantial need in the art for improved devices that are inexpensive to manufacture and make the performance of various magic tricks more easy to master and perform for both the professional and novice magicians and stage performers.

The present invention addresses the deficiencies in the prior art by providing an automatically activated hidden compartment apparatus that can be used for the performance of magic tricks and can be utilized for other less "magical" yet still novel applications such as compact disc (CD) and digital video disc (DVD) cases.

BRIEF DESCRIPTION OF THE DRAWINGS

These as well as other features of the present invention will become more apparent upon reference to the accompanying drawings wherein like numerals designate corresponding parts in the several figures.

Other features and advantages of the invention will become apparent from the following detailed description, taken in conjunction with the accompanying drawings, which illustrate, by way of example, various features of embodiments of the invention.

DETAILED DESCRIPTION OF THE PREFERRED EMBODIMENTS

The following detailed description and accompanying drawings are provided for purposes of illustrating and describing presently preferred embodiments of the invention and are not intended to limit the scope of the invention in any way. It will be recognized that further embodiments of the invention may be used.

In accordance with the preferred embodiment of the present invention, there is provided a hidden compartment apparatus that is inexpensive to manufacture, simple to operate and is automatically actuated by opening and closing the compartment or drawer.

Figure 1:
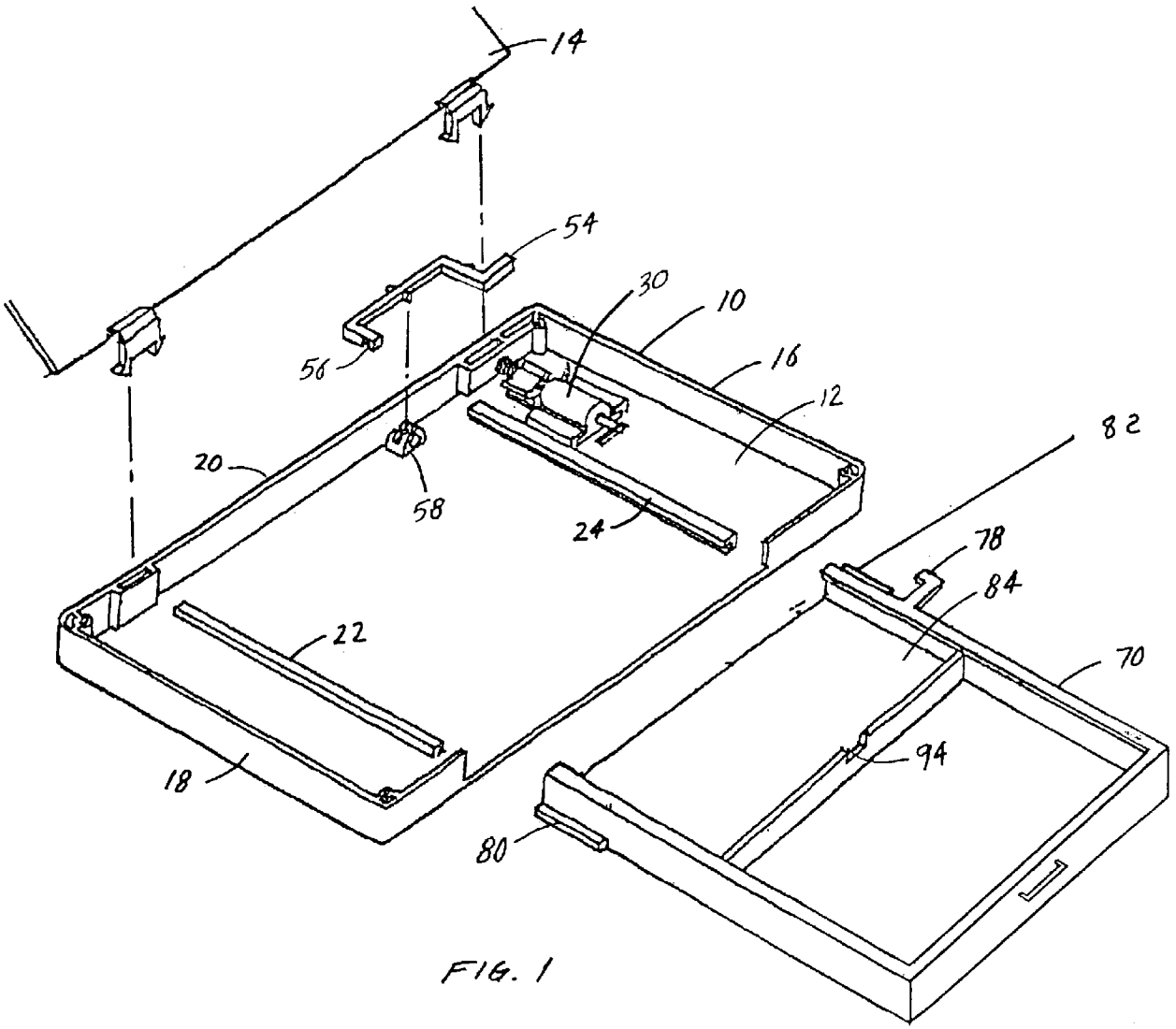
FIG. 1 is an exploded perspective view of the automatically actuated hidden compartment apparatus.

Referring now to the drawings wherein FIG. 1 is an exploded view of the automatically actuated hidden compartment apparatus, which comprises a housing 10, which has a bottom substantially planar surface 12, a top substantially planar surface 14, a first substantially planar side wall 16, a second substantially planar sidewall 18 and a back substantially planar sidewall 20. Coupled to the bottom substantially planar surfaces are first and second drawer guide rails 22 and 24 respectively. An actuating means 30, discussed in more detail below, is removably coupled to the housing 10.

An outer drawer 70 is slidably coupled to the housing 10 via first and second drawer guides 80 and 82, respectively, at the housing first and second drawer guide rails 22 and 24, respectively. The outer drawer 70 comprises an outer drawer bottom substantially planar surface 72, a first outer drawer substantially planar sidewall 74, and a second outer drawer substantially planar sidewall 76. Removably coupled to the first or second outer drawer substantially planar sidewall is an actuating bar 78. Coupled to the first and second outer drawer substantially planar sidewalls are a first drawer guide 80, and a second drawer guide 82 for slidably engaging the first and second drawer guides, respectively.

An inner drawer 84 is slidably coupled to the inside of the outer drawer 70. The inner drawer 84 comprises an inner drawer bottom substantially planar surface 86, a first inner drawer substantially planar sidewall 88, a second inner drawer substantially planar sidewall 90 and an inner drawer substantially planar back wall 92, which has a notch 94 thereon.

Figure 4:
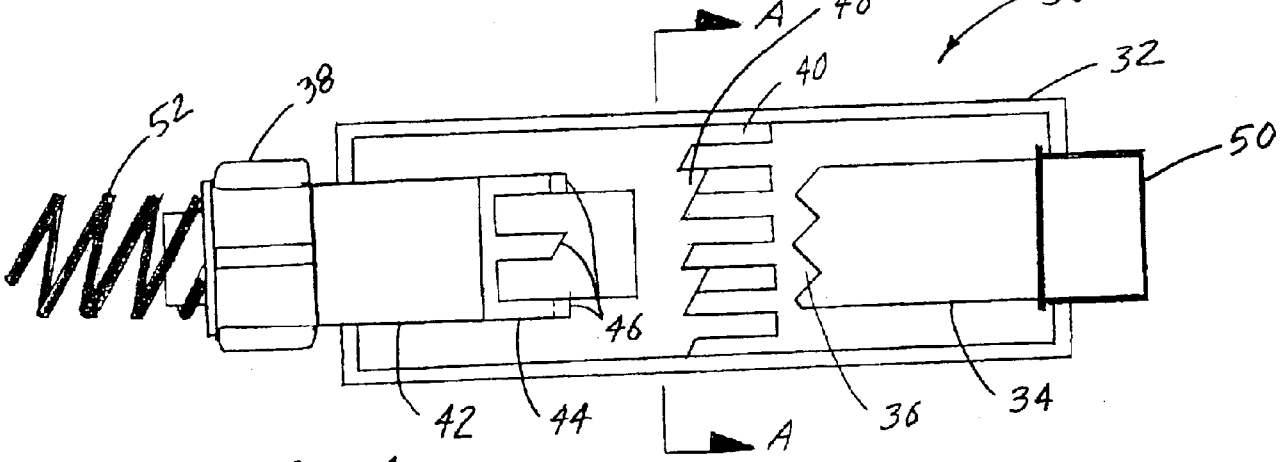
FIG. 4 is a cut-away view of an actuating means.
Figure 5:
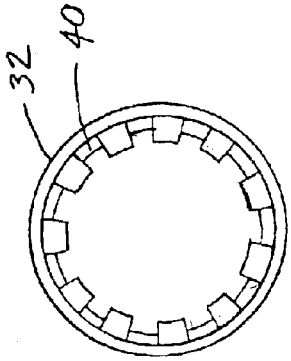
FIG. 5 is a section view taken along lines A—A of FIG. 4.

FIG. 4, is a cut-away view of the actuating means 30, which is a simple push-button activated mechanism like that of a retractable pen. The actuating means 30, is removably coupled to the bottom surface 12 of the housing 10. The actuating means 30 comprises an outer cylindrical housing 32, which has upper fixed slots 48 and lower fixed slots 40 on the inside surface. A thrust tube 34 with catches 36 is rotatably coupled within the outer cylindrical housing 32 for engaging a rotating sleeve 44. The rotating sleeve 44 has teeth 46 and is coupled to an inner cylinder 42 for rotating a gear 38.

Figure 2:
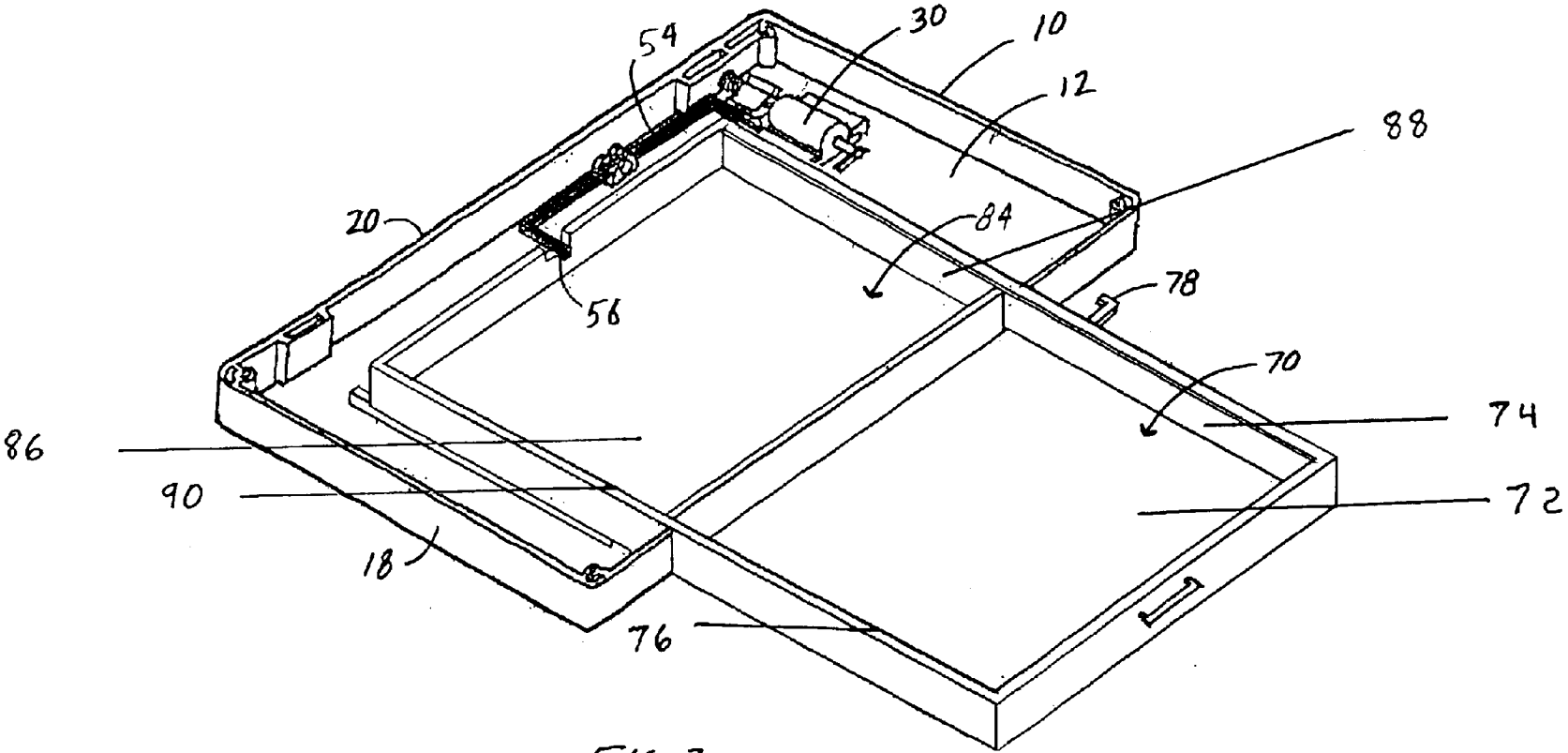
FIG. 2 is a partially exploded perspective view of the automatically actuated hidden compartment apparatus showing the inner drawer being retained by the hook and the outer drawer slid out of the housing.

The actuating bar 78 of the outer drawer 70, is for engaging the actuating means 30, which is coupled to a lever arm 54, such that when the actuating means is actuated, the gear. 38 rotates and pivots the lever arm 54 about the fulcrum 58 such that a hook 56 on the end of the lever arm will engage the notch 94 of the inner drawer 84 to prevent it from being slid out of the housing 10, while allowing only the outer drawer 70 to be slid out of the housing as depicted in FIG. 2.

Figure 3:
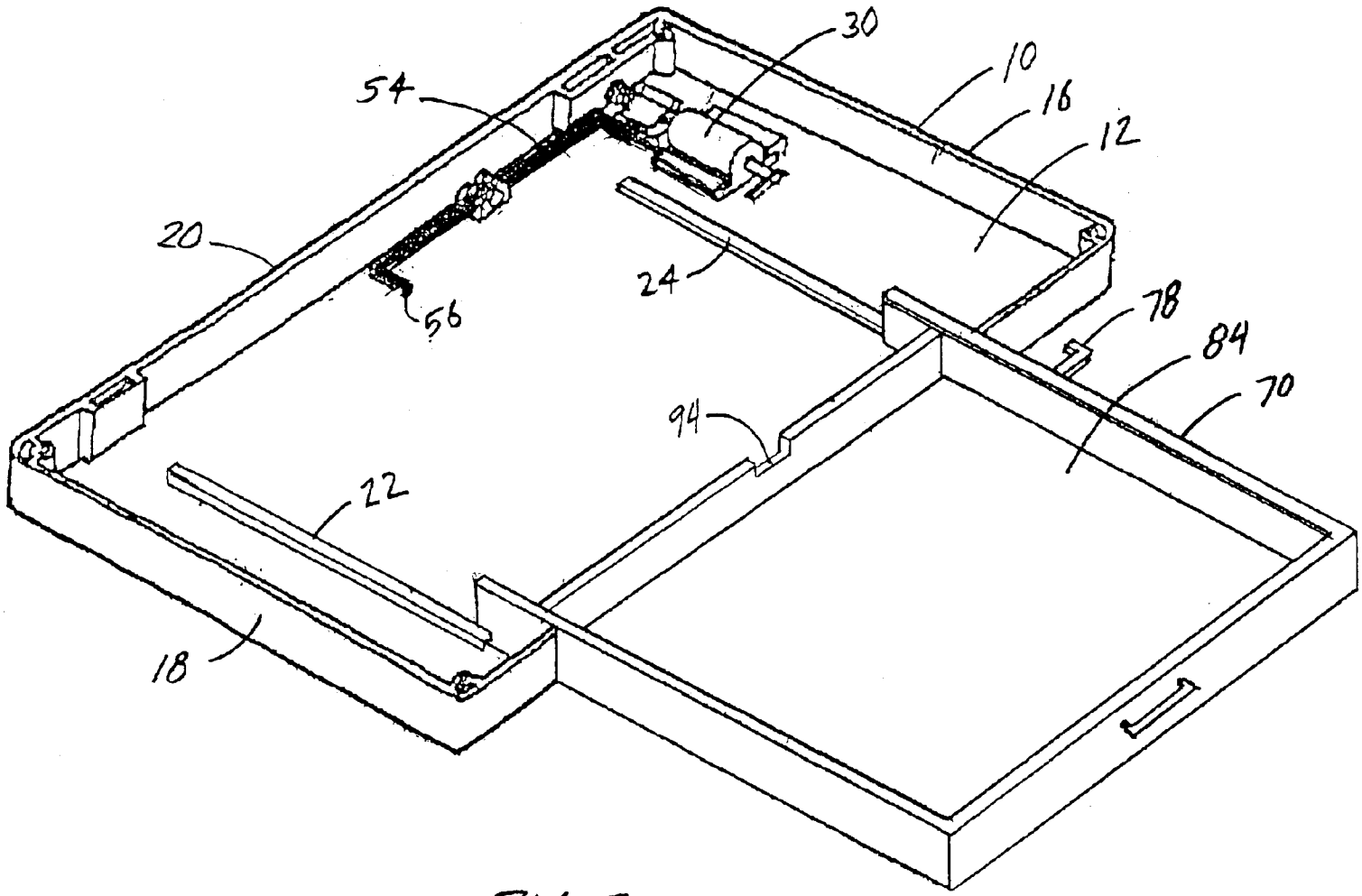
FIG. 3 is a partially exploded view of the automatically actuated hidden compartment apparatus showing the inner drawer not being retained by the hook and both the outer drawer and inner drawer slid out of the housing.

When the outer drawer 70 is then pushed into the housing 10, the actuating bar 78 depresses the push-button 50 of the actuating means 30 to disengage the hook 56, thereby allowing the outer drawer 70 and inner drawer 84 to be slid out of the housing as depicted in FIG. 3.

Referring back to FIG. 4, when the actuating bar 78 of the outer drawer 70 depresses the push-button 50 of the actuating means 30, it pushes forward the thrust tube 34 and the catches 36 of the thrust tube engage the teeth 46 of the rotating sleeve 44 to push forward the inner cylinder 42 to depress the spring 52. When the thrust tube 34 is pushed forward the catches 36 engage the teeth 46 to lift and turn the rotating sleeve 44 such that the teeth 46 of the rotating sleeve 44 can be inserted into the upper fixed slots 48 on the inner surface of the outer cylinder housing 32. This action turns the gear 38 one gear arm. When the push-button 50 is released, the action of the spring 52 retracts the inner cylinder 42 and translationally pushes the teeth 46 of the rotating sleeve 44 to rest in the upper fixed slots 48 of the outer cylinder housing 32.

The inner cylinder 42 is then in the depressed position and the lever arm 54 pivots about the fulcrum 58 such that the hook 56 correspondingly engages the notch 94 of the inner drawer 84 such that the inner drawer is retained in the housing 10 and only the outer drawer 70 can be slid out of the housing 10.

When the push-button 50 is pressed again, the catches 36 of the thrust tube 34 again plunge into the teeth 46 of the rotating sleeve 44. The rotating sleeve 44, which is spring-loaded by the spring 52, then bears on the edges of the upper fixed slots 40, while at the same time the rotating sleeve 44 rotates an amount corresponding to one tooth and the gear 38 correspondingly rotates. When the thrust tube 34 moves back, the rotating sleeve 44 is first lifted and at the same time, turned, which correspondingly rotates the gear 38. The teeth 46 of the rotating sleeve 44 can then plunge into the lower fixed slots 40 of the outer cylinder housing, so that the inner cylinder 42 is retracted and the lever arm 54 pivots about the fulcrun 58 and the hook 56 is correspondingly disengaged with the notch of the inner drawer 92, such that the inner drawer 92 and the outer drawer 70 can both be slid out of the housing 10. The action is again controlled by the rotating sleeve 44, which performs a small rotational movement whenever the push-button 50 is actuated.

An alternative embodiment of the present invention, not depicted in the drawings, has an actuating means 30 that employs a ball catch mechanism 60. That is, when the push-button 50 is pressed, a steel ball 62 rotates in the clockwise direction in a heart-shaped cam recess 64 in the side of a cylinder sleeve 66 attached to the push-button 50. The position of the ball 62 within the cam recess 64 determines the position of the inner cylinder 42. When the push-button 50 has been pressed, the ball 62 is at the top holding point of the cam recess 64. It is held by the pressure of the spring 52. The inner cylinder 42, is then in the depressed position and the lever arm 54 and hook 56, are engaged with the notch 94 of the inner drawer 84. When the push-button 50 is pressed again, the ball 62 goes to the bottom holding point of the cam recess 64, and the inner cylinder 42 slides back into the undepressed position.

In a preferred embodiment, the device is employed in a drawer assembly that can be of various dimensions, according to the size and shape of the articles to be housed inside. It is used to give the illusion that an article placed inside the housing has disappeared when the drawer is closed and then opened. When the drawer is closed again and reopened, the article reappears.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. An automatically actuated hidden compartment apparatus comprising:

a housing;

an outer compartment slidably coupled to said housing;

an inner chamber slidably coupled to the inside of said outer compartment;

automatically actuating means within said housing;

wherein said inner chamber and said outer compartment is slidably opened, an object is placed in said inner chamber;

wherein said inner chamber and said outer compartment is slidably closed, said automatically actuating means is triggered within said housing without the upper interference, thereby preventing said inner chamber from sliding out of said housing;

wherein said inner chamber is prevented from sliding out of said housing and said outer compartment is slidably opened, an illusion is created that said object has disappeared; and wherein said outer compartment is slidably closed, said automatically actuating means is triggered within said housing, thereby allowing said inner chamber to slide open; and wherein said inner chamber and said outer compartment is slidably opened, said object reappears completing the illusion.

2. The automatically actuated hidden compartment apparatus of claim 1, wherein said housing comprises:

a bottom substantially planar surface;

a top substantially planar surface;

a first substantially planar sidewall;

a second substantially planar sidewall;

a back substantially planar sidewall;

a first guide rail; and a second guide rail.

3. The automatically actuated hidden compartment apparatus of claim 1, wherein said outer compartment comprises:

an outer compartment bottom substantially planar surface;

a first outer compartment substantially planar sidewall;

a second outer compartment substantially planar sidewall;

an actuating bar;

a first guide; and a second guide.

4. The automatically actuated hidden compartment apparatus of claim 1, wherein said inner chamber comprises:

an inner chamber bottom substantially planar surface;

a first inner chamber substantially planar sidewall;

a second inner chamber substantially planar sidewall;

an inner chamber substantially planar back wall; and a notch on one of said walls.

5. The automatically actuated hidden compartment apparatus of claim 1, wherein said automatically actuating means comprises:

a push button;

a spring;

an outer cylindrical housing, having upper fixed slots and lower fixed slots on an inside surface of said cylindrical housing;

a thrust tube having catches rotatably coupled within said outer cylindrical housing for engaging a rotating sleeve;

said rotating sleeve having teeth and coupled to an inner cylinder for rotating a gear; and said gear adapted to rotate and pivot a lever arm around a fulcrum such that a hook on the end of said lever will engage or release a notch on said inner chamber to prevent or allow said inner chamber from sliding out of the housing.

6. The automatically actuated hidden compartment apparatus of claim 1, wherein said automatically actuating means comprises:

a push button;

a steel ball;

a heart-shaped cam recess;

a cylinder sleeve; and a inner cylinder.

7. The automatically actuated hidden compartment apparatus of claim 1, wherein said housing has optically perceived indicia thereon.

8. A method of using an automatically actuated hidden compartment apparatus comprising the steps:

providing a housing which has an outer compartment slidingly coupled to inside of said housing; an inner chamber slidingly coupled to the inside of said outer compartment; and an automatically actuating means within said housing;

wherein said inner chamber and said outer compartment is slidingly opened, an object is placed in said inner chamber;

wherein said inner chamber and said outer compartment is slidingly closed, said automatically actuating means is triggered within said housing without the upper interference, thereby preventing said inner chamber from sliding out of said housing;

wherein said inner chamber is prevented from sliding out of said housing and said outer compartment is slidingly opened, an illusion is created that said object has disappeared; and wherein said outer compartment is slidingly closed, said automatically actuating means is triggered within said housing, thereby allowing said inner chamber to slide open; and wherein said inner chamber and said outer compartment is slidingly opened, said object reappears completing the illusion.

9. The method of claim 8, wherein said housing comprises:

a bottom substantially planar surface;

a top substantially planar surface;

a first substantially planar sidewall;

a second substantially planar sidewall;

a back substantially planar sidewall;

a first guide rail; and a second guide rail.

10. The method of claim 8, wherein said outer compartment comprises:

an outer compartment bottom substantially planar surface;

a first outer compartment substantially planar sidewall;

a second outer compartment substantially planar sidewall;

an actuating bar;

a first guide; and a second guide.

11. The method of claim 8, wherein said inner chamber comprises:

an inner chamber bottom substantially planar surface;

a first inner chamber substantially planar sidewall;

a second inner chamber substantially planar sidewall;

an inner chamber substantially planar back wall; and a notch on one of said walls.

12. The method of claim 8, wherein said automatically actuating mean comprises:

a push button;

a spring;

an outer cylindrical housing, having upper fixed slots and lower fixed slots on an inside surface of said cylindrical housing;

a thrust tube having catches rotatably coupled within said outer cylindrical housing for engaging a rotating sleeve;

said rotating sleeve having teeth and coupled to an inner cylinder for rotating a gear; and said gear adapted to rotate and pivot a lever arm around a fulcrum such that a hook on the end of said lever will engage or release a notch on said inner chamber to prevent or allow said inner chamber from sliding out of the housing.

13. An automatically actuated hidden compartment apparatus comprising:

a housing comprising a bottom substantially planar surface, a top substantially planar surface, a first substantially planar sidewall, a second substantially planar sidewall, a back substantially planar sidewall, a first guide rail, and a second guide rail;

an outer compartment slidably coupled to said housing;

an inner chamber slidably coupled to the inside of said outer compartment;

an actuating bar within said housing;

an automatically actuating member within said housing;

wherein said inner chamber and said outer compartment is slidably opened, an object is placed in said inner chamber;

wherein said inner chamber and said outer compartment is slidably closed, said actuating bar triggers said automatically actuating member, thereby preventing said inner chamber from sliding out of said housing;

wherein said inner chamber is prevented from sliding out of said housing and said outer compartment is slidably opened, an illusion is created that said object has disappeared;

wherein said outer compartment is slidably closed, said actuating bar triggers said automatically actuating member, thereby allowing said inner chamber to slide open; and wherein said inner chamber and said outer compartment is slidably opened, said object reappears completing the illusion.

14. The automatically actuated hidden compartment apparatus of claim 13, wherein said outer compartment comprises:

an outer compartment bottom substantially planar surface;

a first outer compartment substantially planar sidewall;

a second outer compartment substantially planar sidewall;

a first guide; and a second guide.

15. The automatically actuated hidden compartment apparatus of claim 13, wherein said inner chamber comprises:

an inner chamber bottom substantially planar surface;

a first inner chamber substantially planar sidewall;

a second inner chamber substantially planar sidewall;

an inner chamber substantially planar back wall; and a notch on one of said walls.

16. The automatically actuated hidden compartment apparatus of claim 13, wherein said automatically actuating member comprises:

a push button;

a spring;

an outer cylindrical housing, having upper fixed slots and lower fixed slots on an inside surface of said cylindrical housing;

a thrust tube having catches rotatably coupled within said outer cylindrical housing for engaging a rotating sleeve;

said rotating sleeve having teeth and coupled to an inner cylinder for rotating a gear; and said gear adapted to rotate and pivot a lever arm around a fulcrum such that a hook on the end the of said lever will engage or release a notch on an inner chamber to prevent or allow said inner chamber from sliding out of the housing.

17. The automatically actuated hidden compartment apparatus of claim 13, wherein said automatically actuating member comprises:

a push button;

a steel ball;

a heart-shaped cam recess;

a cylinder sleeve; and a inner cylinder.

18. The automatically actuated hidden compartment of claim 13, wherein said housing has optically perceived indicia thereon.

19. A method of using an automatically actuated hidden compartment comprising the steps:

providing a housing which has an outer compartment slidingly coupled to inside of said housing; an inner chamber slidingly coupled to the inside of said outer compartment; an actuating bar within said housing; and an automatically actuating member within said housing;

wherein said inner chamber and said outer compartment is slidingly opened, an object is placed in said inner chamber;

wherein said inner chamber and said outer compartment is slidingly closed, said actuating bar triggers said automatically actuating member without the upper interference, thereby preventing said inner chamber from sliding out of said housing;

wherein said inner chamber is prevented from sliding out of said housing and said outer compartment is slidingly opened, an illusion is created that said object has disappeared;

wherein said outer compartment is slidingly closed, said actuating bar triggers said automatically actuating member, thereby allowing said inner chamber to slide open; and wherein said inner chamber and said outer compartment is slidingly opened, said object reappears completing the illusion.

* * * * *